US009540783B2

(12) United States Patent
Lymberis

(10) Patent No.: US 9,540,783 B2
(45) Date of Patent: Jan. 10, 2017

(54) TIE ROD FOR STRUCTURAL PROJECTS

(76) Inventor: Ioannis Lymberis, Agios Ioannis (GR)

( * ) Notice: Subject to any disclaimer, the term of this patent is extended or adjusted under 35 U.S.C. 154(b) by 41 days.

(21) Appl. No.: 12/866,894

(22) PCT Filed: Feb. 5, 2009

(86) PCT No.: PCT/GR2009/000009
§ 371 (c)(1),
(2), (4) Date: May 14, 2012

(87) PCT Pub. No.: WO2009/101454
PCT Pub. Date: Aug. 20, 2009

(65) Prior Publication Data

US 2013/0111828 A1 May 9, 2013

(30) Foreign Application Priority Data

Feb. 14, 2008 (GR) ..... 20080100105

(51) Int. Cl.
*E02D 5/80* (2006.01)
*E02D 5/74* (2006.01)

(52) U.S. Cl.
CPC ..... *E02D 5/805* (2013.01); *E02D 5/803* (2013.01); *E02D 5/80* (2013.01); *E02D 5/801* (2013.01)

(58) Field of Classification Search
CPC ..... E02D 5/80; E02D 5/801; E02D 5/803; E02D 5/74
USPC ..... 52/161, 165, 146, 150, 155, 170
See application file for complete search history.

(56) References Cited

U.S. PATENT DOCUMENTS 96,183 A * 10/1869 Andrews ..... 248/353
354,342 A 12/1886 Pratt
720,225 A * 2/1903 Clum ..... E02D 5/803 411/456
780,039 A * 1/1905 Hurley ..... E02D 5/803 114/305
1,109,478 A * 9/1914 Steadman, Jr. ..... E02D 5/803 52/162

(Continued)

FOREIGN PATENT DOCUMENTS

EP 0884420 A 12/1998
EP 1564349 A1 8/2005

(Continued)

*Primary Examiner* — Phi A

(57) ABSTRACT

The tie rod for structural projects for the protection of structures for earthquake and wind is comprised of a cast iron base (7) which has a bolt (4) passing through a hole, which is surrounded by threaded ring (5) with handles (6). A base plate (2) that sits on the bolt and turns with a ball bearing. A steel cable (9) passes through all; the one end of the cable is fixed to the base (2) with bolts (3). The other end leads to a member with blades around it (10), (12), (13), (14) which open and close around the member (17) with the help of bars (11) connected around the axis of the member with pins. To the other end, they are connected with pins to the blades. The rod presses the structure to the ground by a bolt connected to a cable which pulls a member (17) with blades which open against the sides of a hole drilled on the ground and pull the building towards the ground decreasing torque created by the forces of an earthquake or the wind. It is used on buildings with a frame, continuous building, wood frame houses with storm problems, cable bridges, loose ground slopes, etc.

7 Claims, 4 Drawing Sheets

(56) References Cited

U.S. PATENT DOCUMENTS

| | | | | | |
|---|---|---|---|---|---|
| 1,894,401 | A * | 1/1933 | Hollos | E02D 5/801 | 52/156 |
| 1,948,856 | A * | 2/1934 | Heinrich | 52/161 | |
| 2,078,969 | A * | 5/1937 | Patterson | 52/165 | |
| 2,580,948 | A * | 1/1952 | Pancake | 40/607.08 | |
| 3,763,610 | A * | 10/1973 | Ballew | E02D 5/80 | 52/160 |
| 3,855,745 | A | 12/1974 | Patterson et al. | | |
| 4,547,106 | A | 10/1985 | Lipsker | | |
| 4,593,500 | A | 6/1986 | Watson | | |
| 4,644,712 | A | 2/1987 | Watson | | |
| 4,697,394 | A | 10/1987 | Lu | | |
| 4,707,964 | A * | 11/1987 | Hoyt et al. | 52/741.15 | |
| 5,082,399 | A | 1/1992 | Frease et al. | | |
| 5,108,068 | A * | 4/1992 | Gingras | E04H 12/223 | 248/545 |
| 5,522,184 | A | 6/1996 | Oviedo-Reyes | | |
| 5,634,733 | A * | 6/1997 | Sperduti | F16B 7/0413 | 256/13.1 |
| 5,662,304 | A * | 9/1997 | McDaniel | E04H 12/2223 | 248/499 |
| 5,797,704 | A * | 8/1998 | Collins | 405/237 | |
| 5,904,447 | A * | 5/1999 | Sutton | B09C 1/00 | 175/323 |
| 6,128,867 | A | 10/2000 | MacKarvich | | |
| 6,210,077 | B1 | 4/2001 | Kondo | | |
| 2002/0192034 | A1 | 12/2002 | Kondo et al. | | |
| 2003/0115810 | A1* | 6/2003 | Reinert, Sr. | 52/156 | |
| 2007/0094951 | A1* | 5/2007 | Busto | E02D 5/803 | 52/155 |
| 2010/0000164 | A1* | 1/2010 | Russell | 52/165 | |

FOREIGN PATENT DOCUMENTS

| | | | |
|---|---|---|---|
| GB | 656663 | A | 8/1951 |
| JP | 50018684 | B | 7/1975 |
| JP | 57155428 | A | 9/1982 |
| JP | 57155429 | A | 9/1982 |
| JP | 59154212 | A | 9/1984 |
| JP | 08134908 | A | 5/1996 |
| JP | 2002121735 | A | 4/2002 |
| JP | 2004068470 | A | 3/2004 |
| WO | WO-9714609 | A | 4/1997 |
| WO | WO-9747824 | A | 12/1997 |
| WO | WO-2004094751 | A | 11/2004 |

* cited by examiner

TIE ROD FOR STRUCTURAL PROJECTS

BACKGROUND

Field

This invention pertains to a tie rod for structural projects, which ensures protection of structures from wind and earthquake. Up to now, the efforts of structural sciences were focused on antiseismic protection of buildings and their protection from the wind. Efforts are focused on improvement of the ground, improvement of construction materials and improvement of concrete and iron under the American and German structural regulation. All these are good for structures but they lack a basic element. And that is that structures are not glued to the ground and therefore they can move during an earthquake, they can break and they can fall because of the wind. With the side forces applied by an earthquake or the wind the building is raised from the one side and tilts towards the other. This means that the front sections of the building that are tilted cannot carry the weight of the back side of the building and support the whole weight. The result is that girders are caused to break and the building collapses. The other problem is that concrete that is used as the main structural material in the construction of frames can not withstand the tension even though it withstands compression well. Therefore, as the back side of the building is raised, strong tension and torque forces are formed which result in collapse. In frame buildings, torque depends on two other forces: tension and compression. During an earthquake, on multiple-story buildings the last slab, the middle one and the first one suffer different torque forces and forces in the shape of an 'S' are applied on the building, which are reverse and opposite to one another. There is a staged resonance increase of these forces and the building collapses. This invention aims to the maximum and even zero minimization of these problems so that structures do not collapse.

SUMMARY

According to the invention: this is achieved by applying a prestress force. Prestress is achieved by applying a tensioning force on the building performed from the top of the column to the ground. The tie rod for structural projects undertakes to apply this tensioning force on vertical support elements. Thus, we fix the whole building on the ground. In order to achieve this pull we must first drill holes at the main construction points, such as the bed plates of the frame.

Later we plunge the tie rod with the help of a steel cable connected to its end. By pulling the cable upwards, a mechanism opens the blades of the tie rod and therefore the one side is fixed to the ground. The other side we pass through a plastic pipe so that the cable does get not fixed when the concrete is poured. When construction of the frame is finished, we connect the protruding cable to the tensioning bolt. As we turn the bolt a compression force is exerted towards the ground since the other end of the cable is fixed to the ground. The result is that the bed plates get fixed to the ground. In this way, during an earthquake or side wind forces the bed plates do not jump up or move. And thus, the reason they usually break is avoided. Second, the concrete tensioning strength is increased due to the compression applied on the column by the tie rod. And thus, the second reason that columns break is avoided. Third, if the construction has a single base, which is supported on rubber on individual bed plates and the help of the tie rod, then the building has a vertical micro-movement and at an axis equal to the ground surface with no change on the building's horizontal axis. Because the change in the shape of the straight line of the vertical and horizontal axis of the building and change of the vertical 90° relation of the two axis are responsible for the dual forces and tensions that cause buildings to collapse: and the construction relation above is decreased. The rubber between the single base and the individual bed plates contribute against shocks and absorb ground movement as well as the impact of columns on the ground.

DETAILED DESCRIPTION

Figure 1:
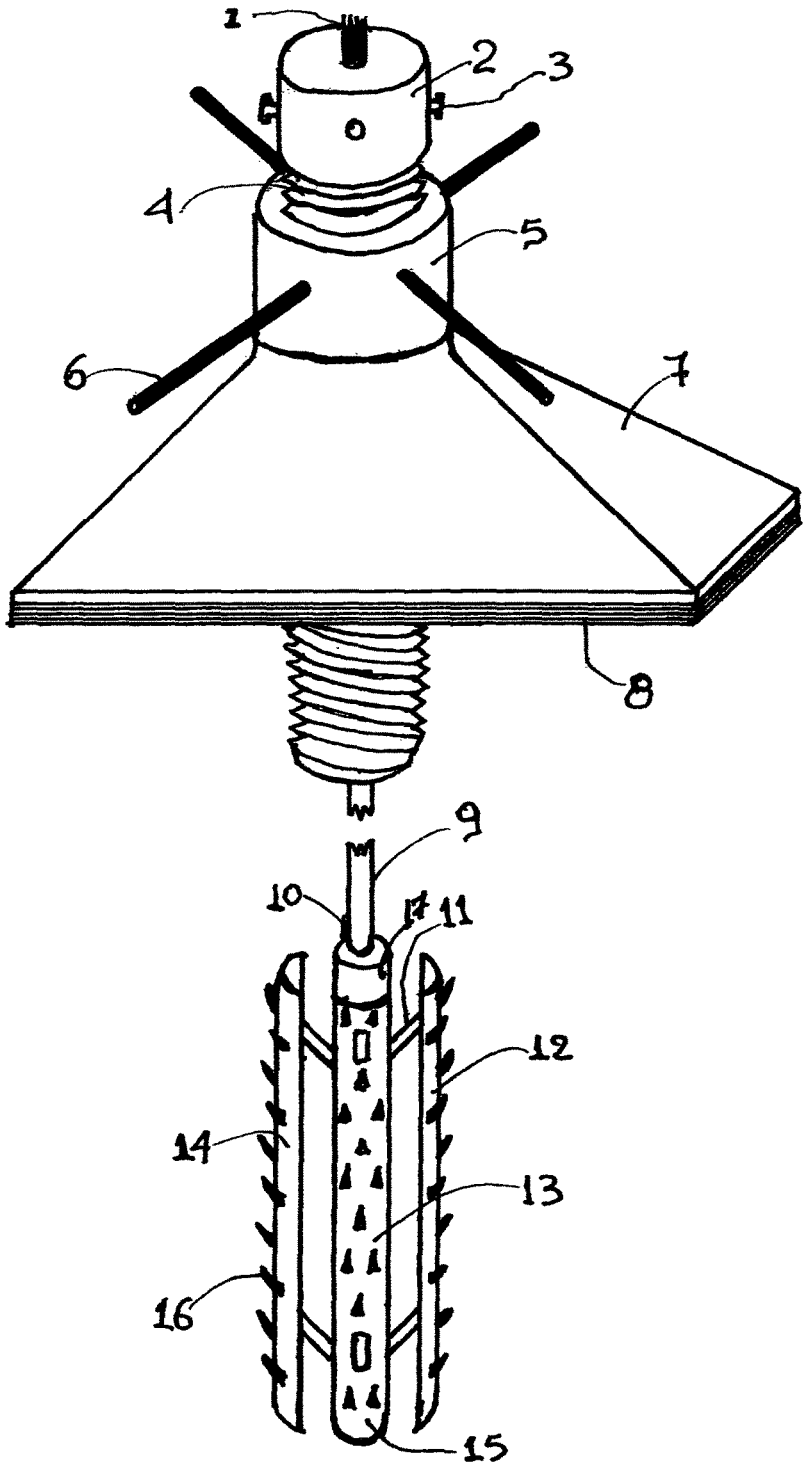
FIG. 1 is a tie rod constructed in accordance with an exemplary embodiment.
Figure 2:
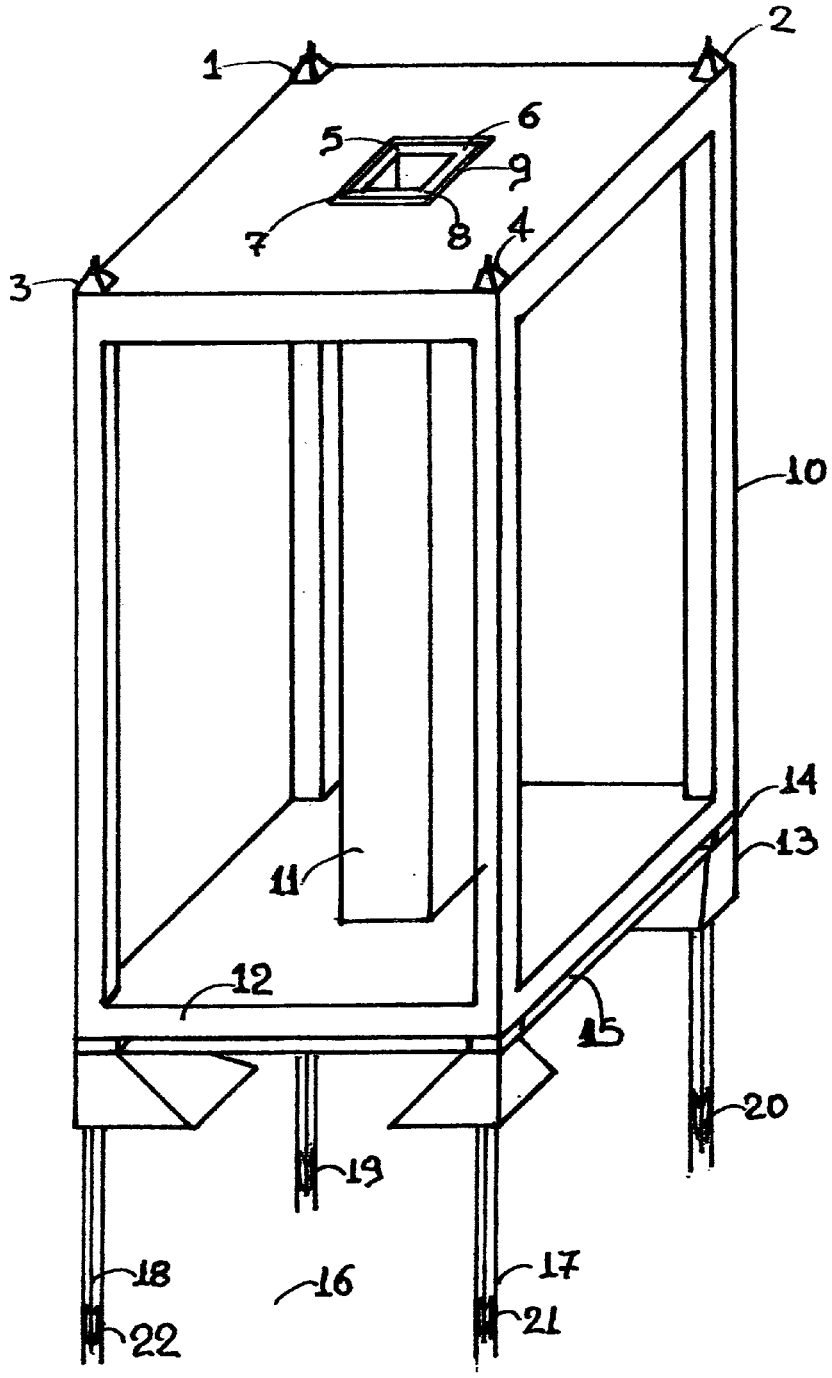
FIG. 2 shows a building with multiple tie rods disposed in accordance with an exemplary embodiment.
Figure 3:
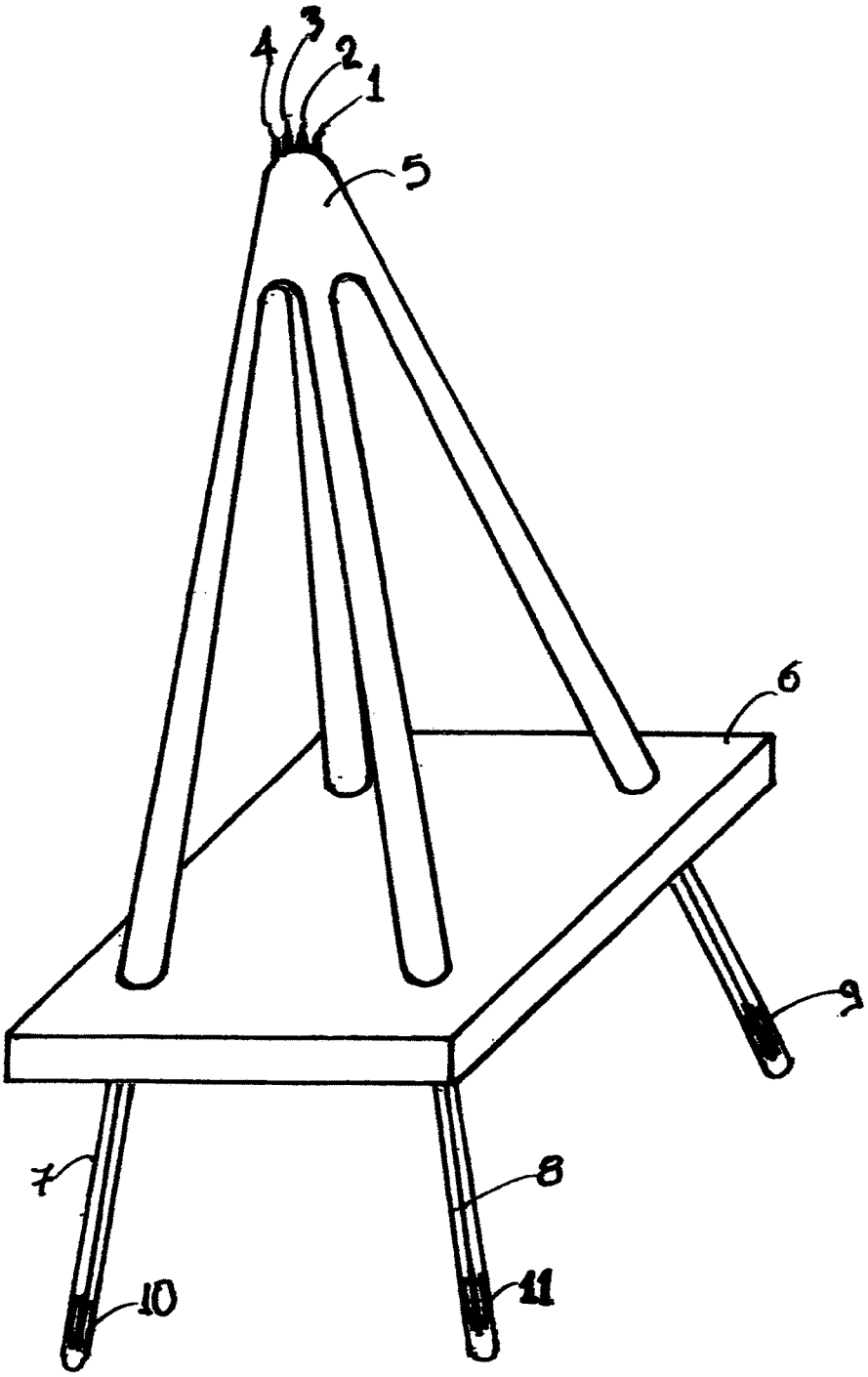
FIG. 3 shows pylons of a suspended cable bridge fixed to the ground using tie rods in accordance with an alternate exemplary embodiment.
Figure 4:
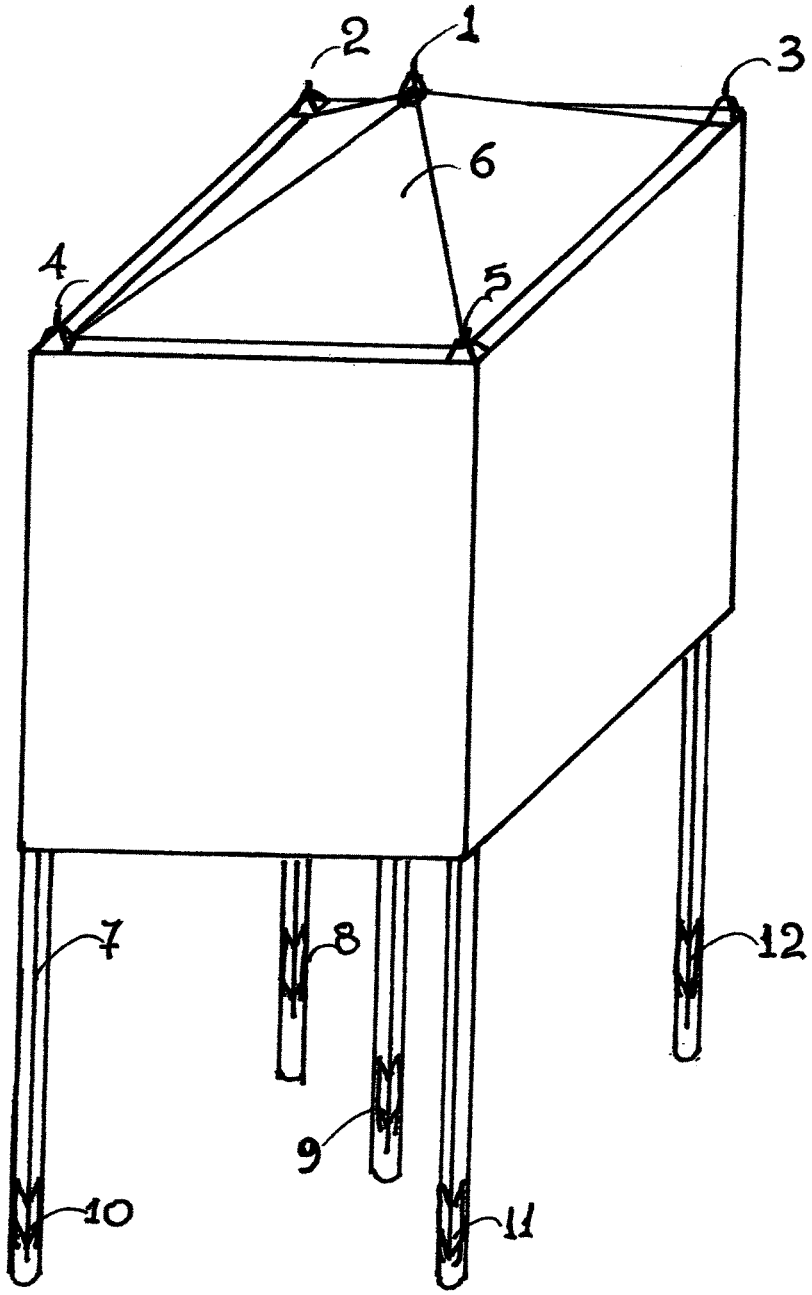
FIG 4. shows a home made of wood construction fixed to the ground using tie rods in accordance with yet a further exemplary embodiment.

The invention is described below with the use of an example and reference to the attached designs:

Design 1 shows a 3-D rendition of the tie rod, its top and bottom part connected with a cable.

Design 2 shows the frame of a building with bed plates (13) and an elevator (11). For the construction of a concrete frame with tie rods, we follow this procedure: we level the ground horizontally. We drill holes at the location of the columns to be constructed, right on the center of their placement on the existing construction, design 2. Drill holes must be perpendicular to the horizontal building axis. The depth of the holes must be ½ the building height. The diameter of the holes must be larger by ⅓ of the tie rod diameter (15). We plunge the tie rod (15) with the help of a cable (9) inside the hole. The tie rod and the cable size varies according to the size of the project. We repeat plunging of the other tie rods in the other locations and leave a length of cable protruding out of them. In all cases, during pouring of concrete we pass the cable through a plastic pipe so that we can later pull it. We also pay attention that the plastic pipes are placed at the center of the column and are vertical before they are covered with the concrete. After the frame is constructed (10), we pull the cable (18) with the help of a bolt (3). As we pull, the blades of the tie rod (22) open and exert a force on the sides of the hole with the help of bars (11). These blades are equipped with pointed ends (13), design 1, for better grip on the ground. Since during an earthquake the ground creates a wave shaped impact, there is a danger that girders and slabs will break. This can be avoided in two ways. We construct the single base because during an earthquake the columns are maintained on the same horizontal or slightly slanted axis of the bed plates (design 2).

The second way is only one single base. But in this case, the tie rods are not placed on the columns but on the corners of the elevator (design 2) on locations (5), (6), (7) and (8) and pull on the elevator. It would be good if it is located in the center of the building. We pay attention to leave an elastic contraction joint (9) with enough tolerance so that the building can shake around it so as not to break but maintains its axis on a straight line.

Other points where the tie rod can be applied we find in design 3, where the pylons of a suspended cable bridge are fixed to the ground for antiseismic and wind protection reasons. In design 4, we see the wood construction of a home fixed to the ground for protection from tornado winds. Even if we suppose in design 4 that the structure is made of bricks and we place the tie rods in points (1), (2), (3), (4) and (5), we increase its seismic strength. The tie rods can also be used for shoring up loose ground with the help of an iron net.

The structural tie rod is comprised of a stainless steel member (17) which has eight stainless steel bars (11) which are connected to the member on the one end with a pin and on the other end the bars are connected to four blades located on the perimeter of the member (12), (13), (14), (10) in design 1. The exterior side of the blades is covered with pointed edges (13) which aid the blades to grip. The extension of the member is comprised of a steel cable (9) with a rubber jacket for protection from rust. This cable is fixed inside the member. Its length extends along the whole length of the hole drilled and along height of the whole building. At its other end, it passes through the hole of a bolt (4), design 1, and comes out of the hole. The bolt (4) passes through a cast iron base plate (7) and moves vertically up-and-down on the base with the help of a threaded ring (5) with the same threading as the bolt and touches the top of the base plate (7). This threaded ring has four turning handles (6) for screwing. The bolt (4) has a base plate at its top (2) with a hole (1) so the steel cable can pass through it (9). The base plate has bolts along its perimeter at a different height in order to achieve fixing of the cable. This base plate (2) ensures turning of the threaded ring (5) without turning of the cable (9) because it sits on the bolt (4) with and exterior ball bearing. As the threaded ring turns (5), the bolt (4) rises and as the cable is fixed, it rises with the resistance. As it rises, it pulls the member (17). Then, the bars open (11) around the member (17) forcing the blades against the sides of the hole. Since the diameter of the opened tie rod is greater than the hole drilled, it presses the blades and the pointed edges, it grips and causes the cable to rise. Then, the whole system presses the structure towards the ground with the help of the cast iron base plate (7).

The invention claimed is:

1. A tensioning bolt system for use in a tie rod where the tie rod is configured to connect, at one end, to an upper surface of a building via the tensioning bolt system and at an opposite end, via a respective cable with at least one anchor, to the ground underneath the building, the tensioning bolt system comprising a base having a hole, where a bolt housing a respective cable passes through the hole and a threaded ring, having a plurality of turning handles, is screwed around the bolt, wherein the tensioning bolt system is sized and fitted to transfer wave shaped impact forces such as those generated during an earthquake into forces carried by the respective cable to the at least one anchor, which at least one anchor is fitted and sized to expand or retract to/from the ground where each is designed to be installed in order to prevent tensioning forces from being directed toward structural columns and other members of the building.

2. The tensioning bolt system of claim 1, further comprising a base, screwed on top of the bolt, having a plurality of holes where small bolts are inserted to fix one end of the respective cable and ensure that the steel cable will not turn when the threaded ring turns because the cable sits on the bolt with an internal ball bearing.

3. The tensioning bolt system of claim 1, wherein the tensioning bolt system is secured to the upper surface of the building by torqueing the cables connected to the tensioning bolt system and the anchors, which in turn causes the anchors to grip the ground and fasten the entire tie rod into position.

4. The tensioning bolt system of claim 3, wherein the cables are disposed via piping within the structural columns allowing the cable to expand and retract.

5. The tensioning bolt system of claim 1, where the tie rod is configured to facilitate securing the structure by placing at least one anchor at a corner position of the structure.

6. The tensioning bolt system of claim 1, where the tie rod is configured to facilitate securing the structure by placing at least one anchor at a position relative a fixed elevator shaft to allow the rest of the building to be flexible up to a certain point.

7. The tensioning bolt system of claim 1, where the tie rod is configured for use in a building with a plurality of floor plates and an elastic contraction joint with sufficient clearance placed between the shaft wall of the fixed elevator shaft and each floor plate in order for the building to oscillate around the fixed elevator shaft and hit against the anchored fixed elevator shaft before reaching breaking point in the event of an earthquake.

* * * * *